US006321577B1

(12) United States Patent
Tsai

(10) Patent No.: US 6,321,577 B1
(45) Date of Patent: Nov. 27, 2001

(54) TRANSMISSION MECHANISM FOR WEFT BARS OF KNITTING MACHINE

(76) Inventor: Ming-Hong Tsai, 108 Tur Nun Road, Pei Tou-Township, Chan Hua-Hsien (TW)

( * ) Notice: Subject to any disclaimer, the term of this patent is extended or adjusted under 35 U.S.C. 154(b) by 0 days.

(21) Appl. No.: 09/816,309

(22) Filed: Mar. 26, 2001

(51) Int. Cl.[7] ..... D04B 23/00
(52) U.S. Cl. ..... 66/207
(58) Field of Search ..... 66/203, 204, 207, 66/208

(56) References Cited

U.S. PATENT DOCUMENTS

| | | | | |
|---|---|---|---|---|
| 4,414,826 | * | 11/1983 | Mista et al. | 66/207 |
| 4,611,475 | * | 9/1986 | Bergmann | 66/207 |
| 5,307,648 | * | 5/1994 | Forkert et al. | 66/207 |
| 5,311,751 | * | 5/1994 | Winter et al. | 66/207 |
| 5,327,750 | * | 7/1994 | Speich | 66/207 |

FOREIGN PATENT DOCUMENTS

| | | | | |
|---|---|---|---|---|
| 3213663 | * | 10/1983 | (DE) | 66/207 |

* cited by examiner

*Primary Examiner*—Danny Worrell
(74) *Attorney, Agent, or Firm*—Rabin & Berdo, P.C.

(57) ABSTRACT

A transmission mechanism for weft bars of knitting machine comprises pairs of connecting rods each pair having one end coupled to the weft bar; connection members having one ends coupled to the other ends of the connecting rods; universal rods having one ends pivotably coupled to the other ends of the connection members; upper engagement blocks having upper sides pivotably coupled to the other ends of the universal rods; lower engagement blocks having top teeth on either end; belts each having parallel teeth on the inner surface, each belt being movable between the upper and the lower engagement blocks with the teeth thereof meshed with the top teeth of the lower engagement block; two transverse rods inserted through the lower engagement block for connecting the lower engagement block and the knitting machine together; sensors each secured on the upper engagement block for controlling the motions of the upper and the lower engagement blocks; pairs of idler gears each pair provided on two sides of the belt; pairs of shafts each for supporting the idler gear; motors each having a gear wheel meshed with the teeth on the bottom of the belt; and two plates each having seats of different length for supporting the motors.

1 Claim, 6 Drawing Sheets

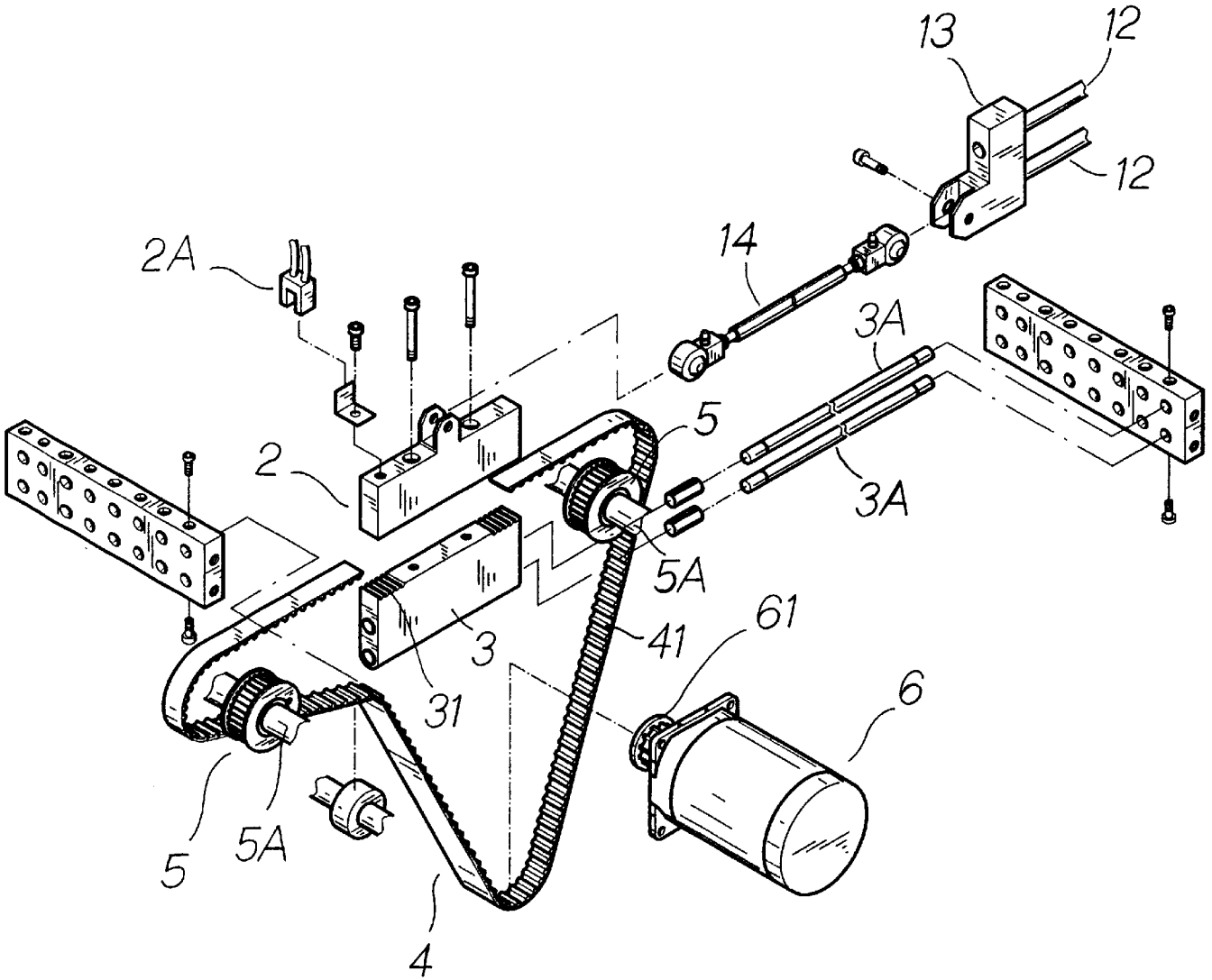
FIG. 2-A

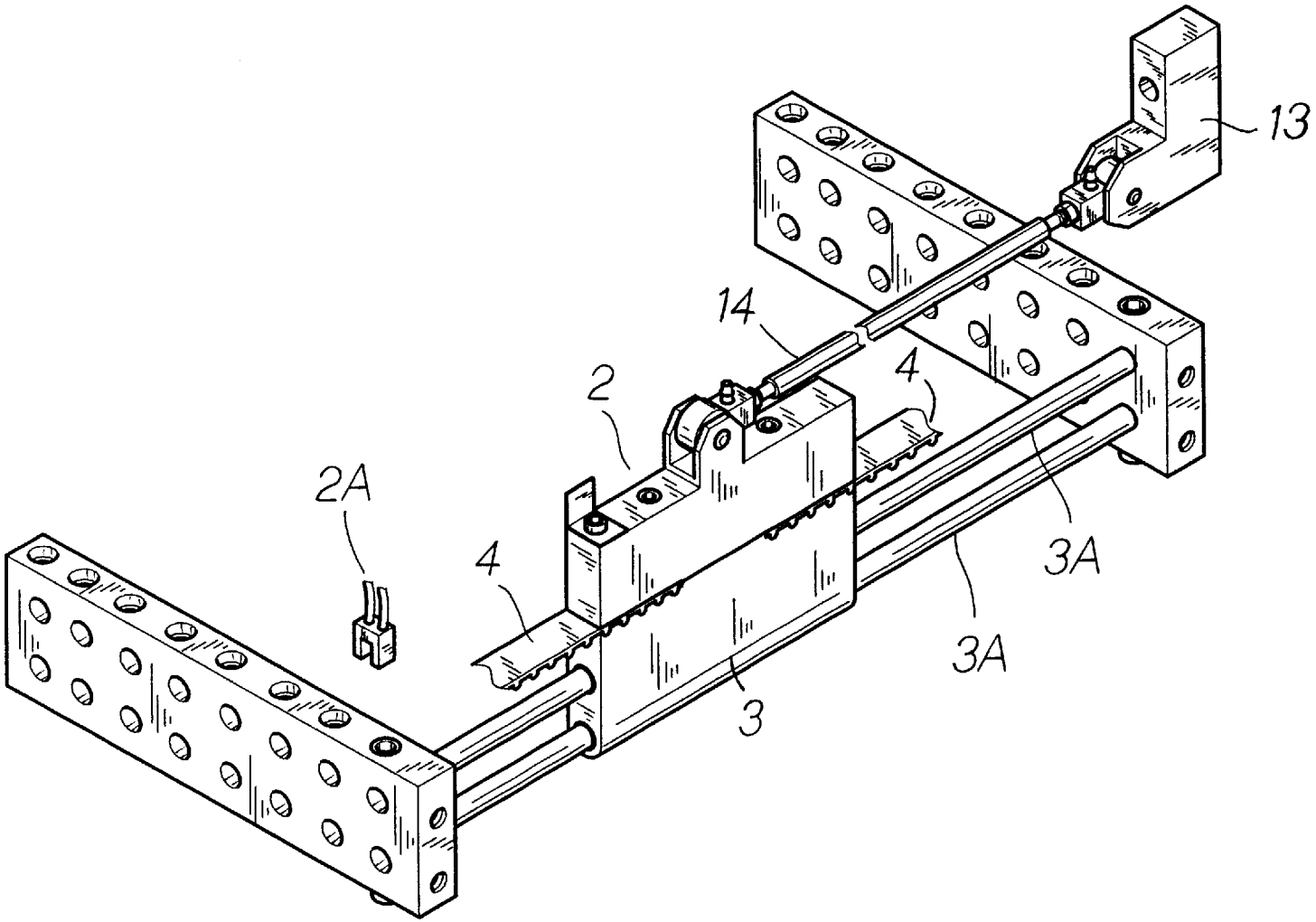
FIG. 2-B

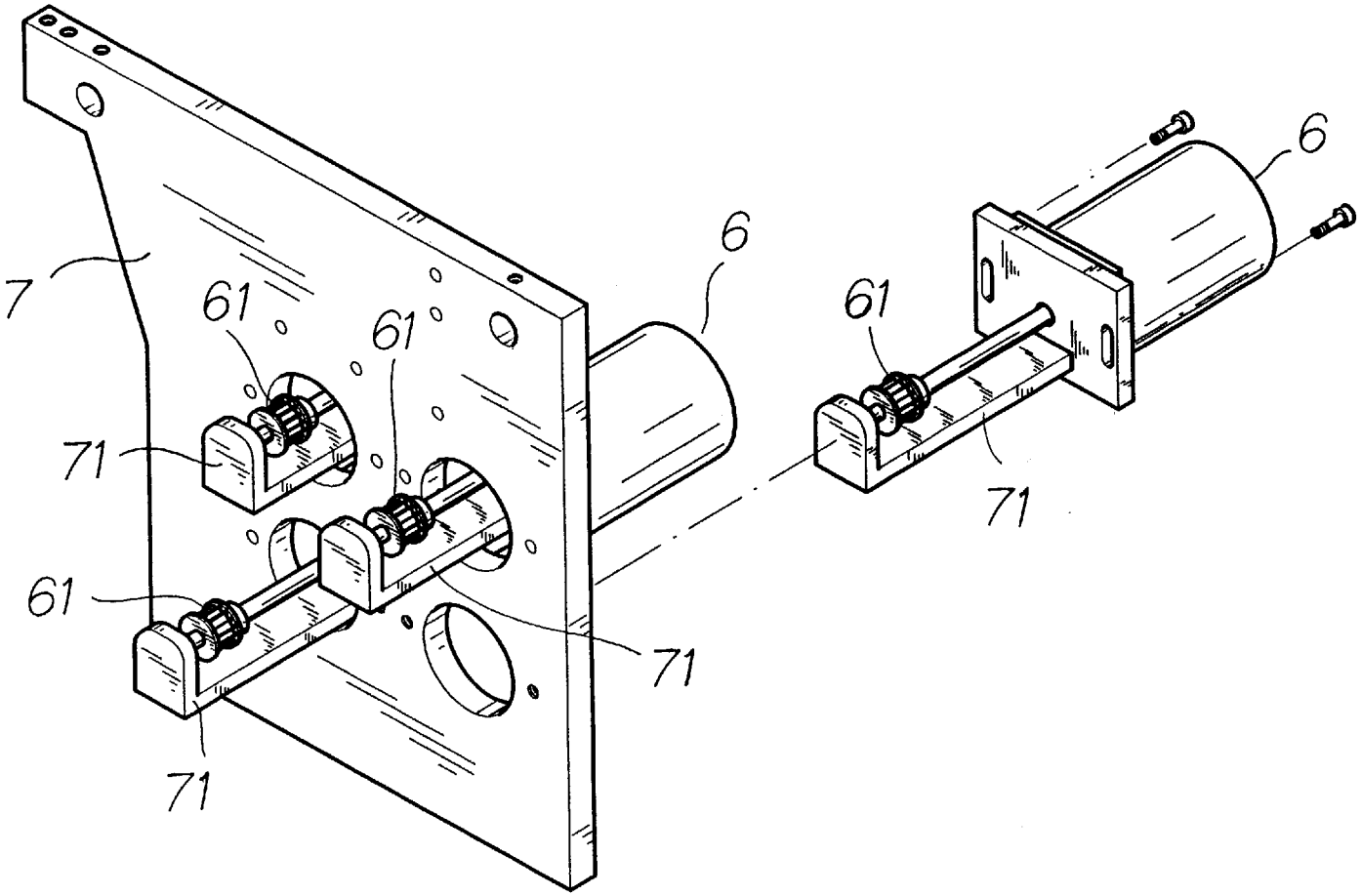
FIG. 2–C

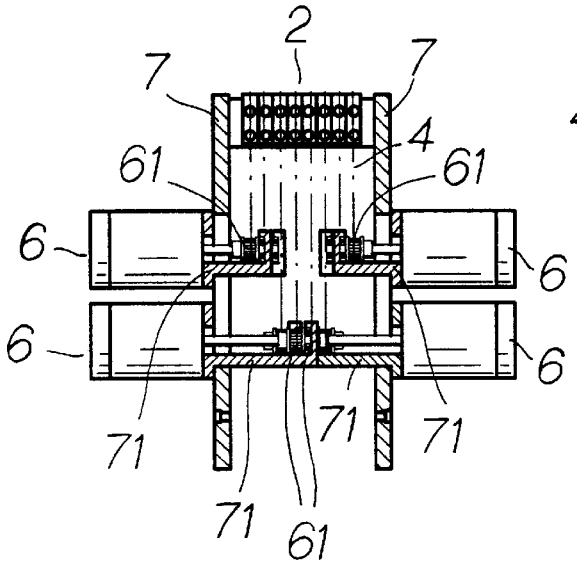
FIG. 3-C
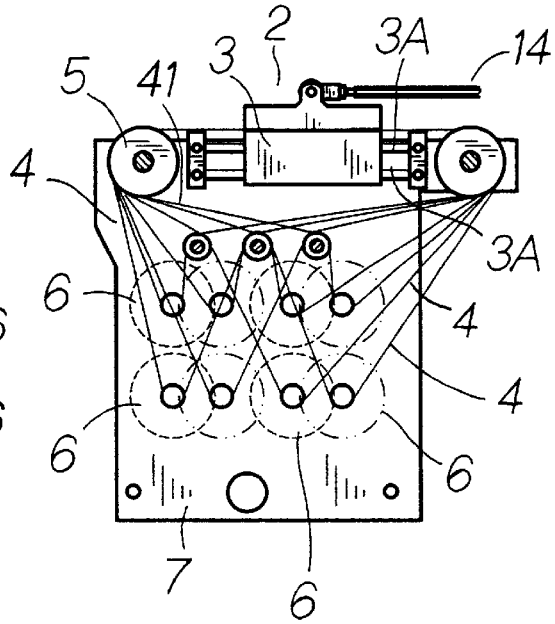
FIG. 3-A
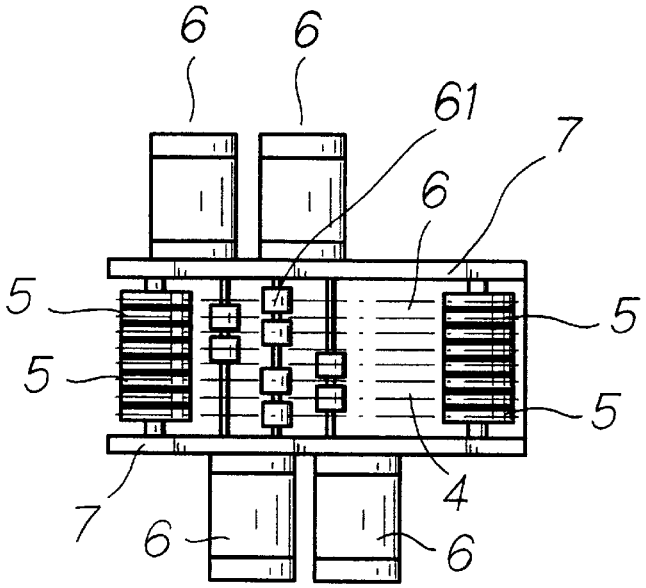
FIG. 3-B

TRANSMISSION MECHANISM FOR WEFT BARS OF KNITTING MACHINE

FIELD OF THE INVENTION

The present invention relates to knitting machines and more particularly to an improved transmission mechanism for weft bars of knitting machine.

BACKGROUND OF THE INVENTION

Conventionally, weft bars are activated by cams through connecting rods thereof. Such operation is disadvantageous for component wearing, malfunctioning and noise. Further, the replacement of component is tedious and time consuming. Furthermore, the requirement for the correction of newly installed component is very high, thus causing inconvenience to operator. Therefore, improvement exists.

SUMMARY OF THE INVENTION

It is an object of the present invention to provide a transmission mechanism for a plurality of weft bars of a knitting machine comprising a plurality of pairs of connecting rods each pair having one end coupled to the weft bar; a plurality of connection members having one ends coupled to the other ends of the connecting rods; a plurality of universal rods having one ends pivotably coupled to the other ends of the connection members; a plurality of upper engagement blocks having upper sides pivotably coupled to the other ends of the universal rods; a plurality of lower engagement blocks having top teeth on either end; a plurality of belts each having a plurality of parallel teeth on the inner surface, each belt being movable between the upper engagement block and the lower engagement block with the teeth thereof meshed with the top teeth of the lower engagement block; two transverse rods inserted through the lower engagement block for connecting the lower engagement block and the knitting machine together; a plurality of sensors each secured on the upper engagement block for sensing and controlling the motions of the upper engagement block and the lower engagement block; a plurality of pairs of idler gears each pair provided on two sides of the belt; a plurality of pairs of shafts each for supporting the idler gear; a plurality of motors each having a gear wheel meshed with the teeth on the bottom of the belt; and two plates each having a plurality of seats for supporting the motors wherein one of the seats has a length different from the other.

The above and other objects, features and advantages of the present invention will become apparent from the following detailed description taken with the accompanying drawings.

BRIEF DESCRIPTION OF THE DRAWINGS

FIG. 2A is an exploded view of the FIG. 1 transmission mechanism;

FIG. 2B is a perspective view showing assembled upper engagement block and lower engagement block of FIG. 1;

FIG. 2C is an exploded perspective view showing the arrangement of motors of FIG. 1;

FIG. 3A is a schematic side view of FIG. 2;

FIG. 3B is a schematic top view of FIG. 3A; and

FIG. 3C is another schematic side view in part section of FIG. 2.

DETAILED DESCRIPTION OF THE PREFERRED EMBODIMENTS

Figure 1:
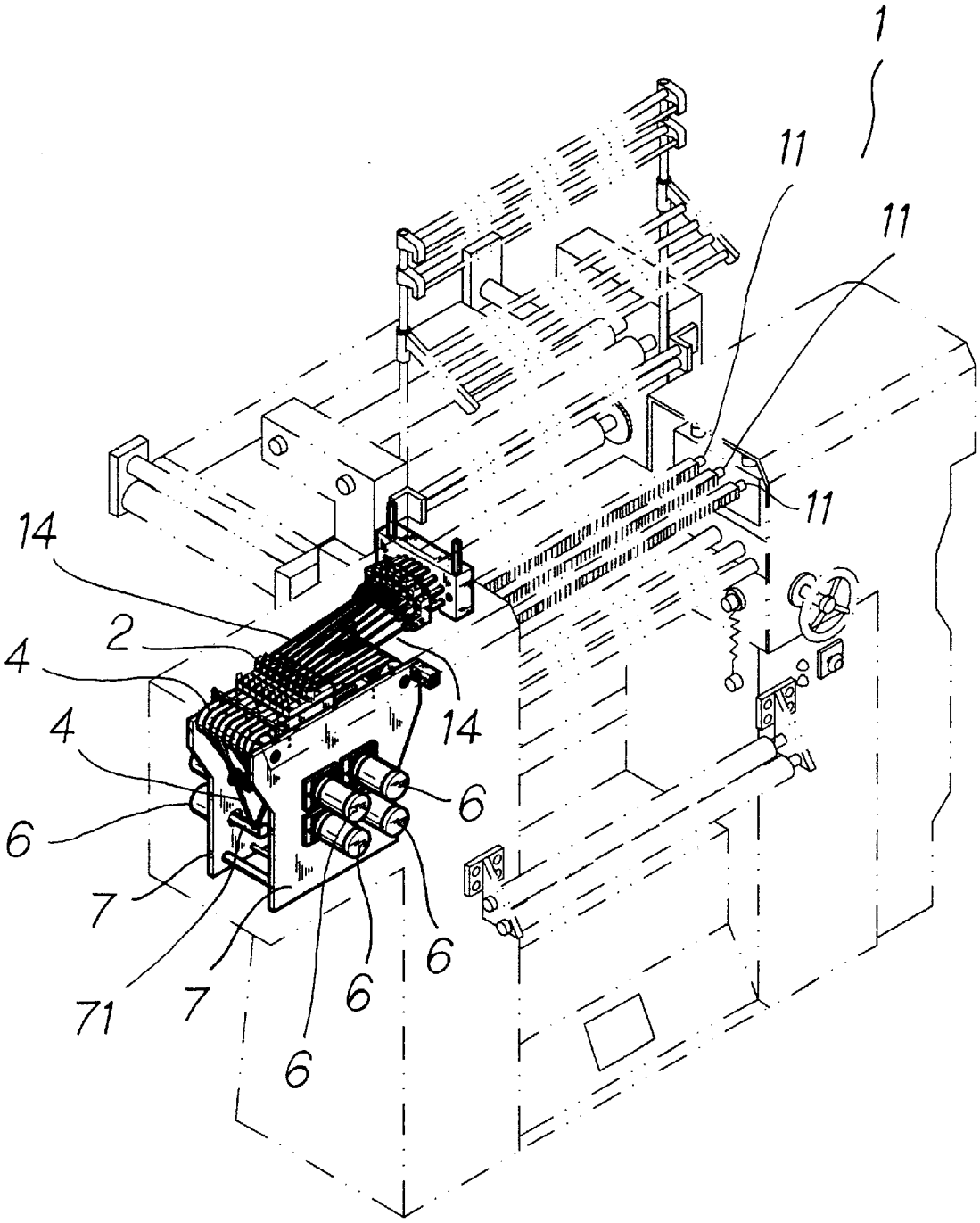
FIG. 1 is a perspective view of a transmission mechanism for weft bars of knitting machine according to the invention.
Figure 2:
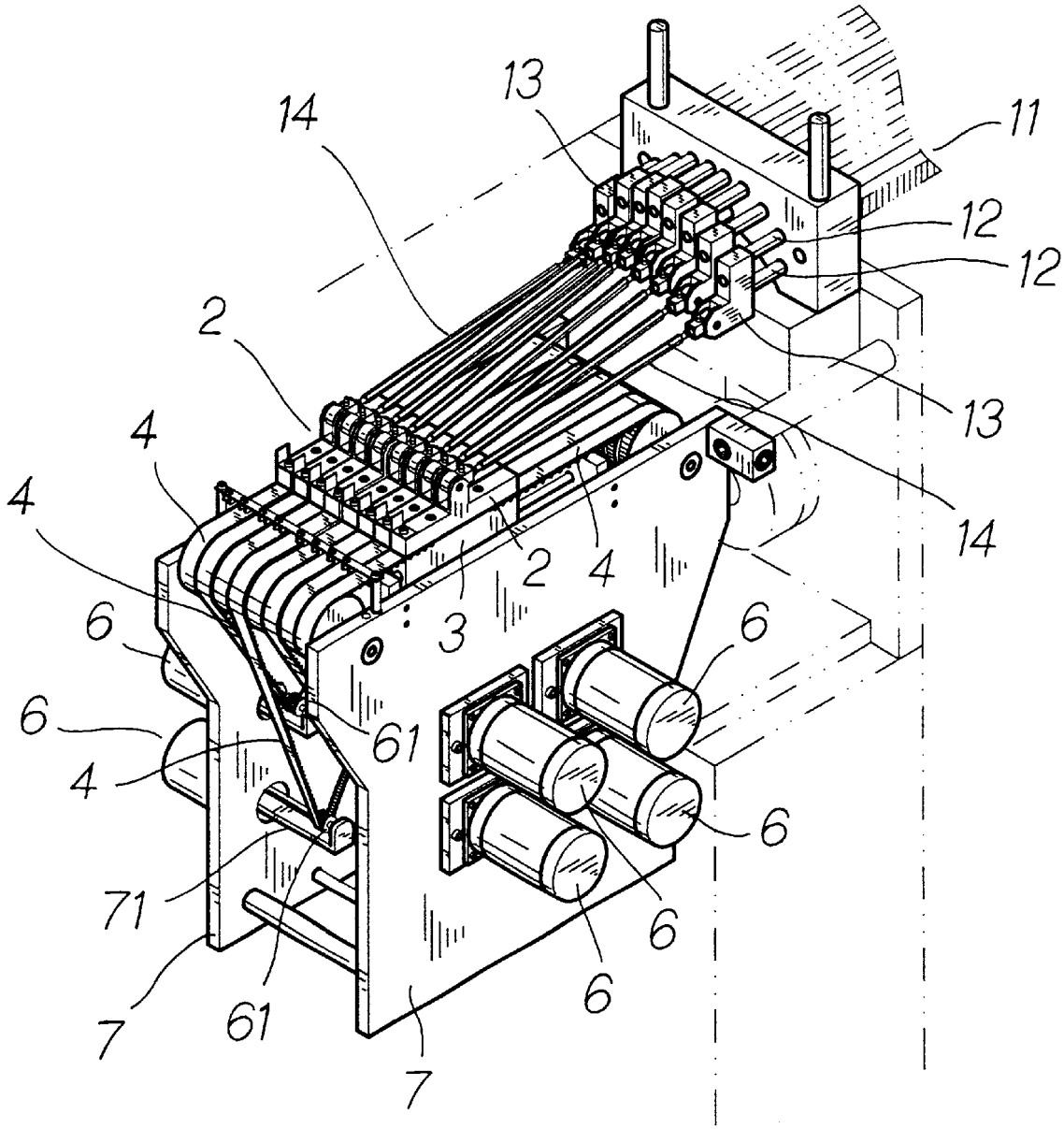
FIG. 2 is an enlarged view of the FIG. 1 transmission mechanism.

Referring to FIGS. 1 to 2C, there is shown a transmission mechanism for weft bars 11 of knitting machine 1 constructed in accordance with the invention. Two connecting rods 12 are coupled between weft bar 11 and one of connection members 13. A universal rod 14 is pivotably coupled between connection member 13 and upper engagement block 2. A belt 4 has a plurality of parallel teeth 41 on the inner surface. Belt 4 is movable between upper engagement block 2 and lower engagement block 3 with teeth 41 meshed with either mating teeth 31 of lower engagement block 3. Two transverse rods 3A are inserted through lower engagement block 3 so as to connect lower engagement block 3 and knitting machine 1 together. A sensor 2A is secured on upper engagement block 2 for sensing and controlling the motions of upper engagement block 2 and lower engagement block 3. Two idler gears 5 are provided on two sides of belt 4. Each idler gear 5 is supported by a shaft 5A. Any one of a plurality of motors 6 has a gear wheel 61 meshed with teeth 41 on the bottom of belt 4. A plate 7 has a plurality of seats 71 for supporting motors 6 wherein any seat 71 has a length different from the other.

Referring to FIGS. 3A to 3C, the operation of the transmission mechanism for weft bars 11 of knitting machine 1 will now be described below when the transmission mechanism is assembled. In operation, belts 4 are rotated in a high speed when motors 6 are activated. Also, the reciprocating motions of upper engagement block 2 and lower engagement block 3 are reliably smooth by the provision of transverse rods 3A. As a result, the operating speed of weft bars 11 is reliably fast. Most importantly, weft bars 11 are well cooperated with transmission mechanism.

While the invention has been described by means of specific embodiments, numerous modifications and variations could be made thereto by those skilled in the art without departing from the scope and spirit of the invention set forth in the claims.

What is claimed is:

1. A transmission mechanism for a plurality of weft bars of a knitting machine comprising:

a plurality of pairs of connecting rods each pair having one end coupled to said weft bar;

a plurality of connection members having one ends coupled to said other ends of said connecting rods;

a plurality of universal rods having one ends pivotably coupled to said other ends of said connection members;

a plurality of upper engagement blocks having upper sides pivotably coupled to said other ends of said universal rods;

a plurality of lower engagement blocks having top teeth on either end;

a plurality of belts each having a plurality of parallel teeth on said inner surface, each belt being movable between said upper engagement block and said lower engagement block with said teeth thereof meshed with said top teeth of said lower engagement block;

two transverse rods inserted through said lower engagement block for connecting said lower engagement block and said knitting machine together;

a plurality of sensors each secured on said upper engagement block for sensing and controlling said motions of said upper engagement block and said lower engagement block;

a plurality of pairs of idler gears each pair provided on two sides of said belt;

a plurality of pairs of shafts each for supporting said idler gear;

a plurality of motors each having a gear wheel meshed with said teeth on said bottom of said belt; and two plates each having a plurality of seats for supporting said motors wherein one of said seats has a length different from the other.

* * * * *